US009787020B2

(12) United States Patent
Choi et al.

(10) Patent No.: US 9,787,020 B2
(45) Date of Patent: Oct. 10, 2017

(54) HIGH-VOLTAGE MALE CONNECTOR

(71) Applicant: LS CABLE & SYSTEM LTD, Anyang-si, Gyeonggi-do (KR)

(72) Inventors: Jeong-Hyeok Choi, Anyang-si (KR); Moon-Kyu Jang, Suwon-si (KR); Heung-Kyu Lee, Suwon-si (KR)

(73) Assignee: LS CABLE & SYSTEM LTD., Anyang-si, Gyeonggi-do (KR)

( * ) Notice: Subject to any disclaimer, the term of this patent is extended or adjusted under 35 U.S.C. 154(b) by 0 days.

(21) Appl. No.: 15/125,080

(22) PCT Filed: Jul. 2, 2014

(86) PCT No.: PCT/KR2014/005902

§ 371 (c)(1),
(2) Date: Sep. 9, 2016

(87) PCT Pub. No.: WO2015/137568

PCT Pub. Date: Sep. 17, 2015

(65) Prior Publication Data

US 2017/0025787 A1 Jan. 26, 2017

(30) Foreign Application Priority Data

Mar. 14, 2014 (KR) ..... 10-2014-0030212

(51) Int. Cl.
*H01R 13/44* (2006.01)
*H01R 13/53* (2006.01)
(Continued)

(52) U.S. Cl.
CPC ..... *H01R 13/53* (2013.01); *H01R 13/62* (2013.01); *H01R 24/28* (2013.01); *H01R 24/76* (2013.01);
(Continued)

(58) Field of Classification Search
CPC ..... H01R 13/44; H01R 13/035; H01R 13/53; H01R 24/76; H01R 24/28
(Continued)

(56) References Cited

U.S. PATENT DOCUMENTS 8,545,275 B2 * 10/2013 Wang ..... H01R 13/44 439/680
8,951,051 B2 * 2/2015 Natter ..... H01R 13/04 439/135
(Continued)

FOREIGN PATENT DOCUMENTS

JP 2002-056919 A 2/2002
JP 2011-048983 A 3/2011
(Continued)

OTHER PUBLICATIONS

International Search Report for PCT/KR2014/005902 dated Dec. 5, 2014 from Korean Intellectual Property Office.

*Primary Examiner* — Renee Luebke
*Assistant Examiner* — Paul Baillargeon
(74) *Attorney, Agent, or Firm* — Paratus Law Group, PLLC

(57) ABSTRACT

Disclosed is a high-voltage male connector including: a male terminal formed of a metal material and having a plate shape; an insulating cap provided on a front end of the male terminal; an inner housing into which the male terminal is inserted and mounted such that the front end of the male terminal faces the outside; a partition unit integrally formed with an inner side of the inner housing and having a tetragonal pipe shape covering the male terminal; and an outer housing which is formed of a metal material and into which the inner housing is inserted and mounted.

13 Claims, 8 Drawing Sheets

(51) Int. Cl.

| | |
|---|---|
| ***H01R 13/62*** | (2006.01) |
| ***H01R 24/28*** | (2011.01) |
| ***H01R 24/76*** | (2011.01) |
| *H01R 103/00* | (2006.01) |

(52) U.S. Cl.
CPC ..... *H01R 13/44* (2013.01); *H01R 2103/00* (2013.01); *H01R 2201/20* (2013.01)

(58) Field of Classification Search
USPC ..... 439/886, 181, 733.1, 752.5
See application file for complete search history.

(56) References Cited

U.S. PATENT DOCUMENTS

| | | | |
|---|---|---|---|
| 2011/0045699 | A1 | 2/2011 | Youn et al. |
| 2011/0053404 | A1 | 3/2011 | Tsuruta et al. |

FOREIGN PATENT DOCUMENTS

| | | | |
|---|---|---|---|
| KR | 10-2009-0105062 | A | 10/2009 |
| KR | 10-2009-0105069 | A | 10/2009 |
| KR | 10-2013-0129614 | A | 11/2013 |

* cited by examiner (a)

(b)

(a)

(b)

HIGH-VOLTAGE MALE CONNECTOR

CROSS REFERENCE TO PRIOR APPLICATIONS

This application is a National Stage Patent Application of PCT International Patent Application No. PCT/KR2014/005902 (filed on Jul. 2, 2014) under 35 U.S.C. §371, which claims priority to Korean Patent Application No. 10-2014-0030212 (filed on Mar. 14, 2014), which are all hereby incorporated by reference in their entirety.

BACKGROUND

1. Field

The present invention relates to a high-voltage male connector, and more particularly, to a male connector among a pair of high-voltage connectors, which is capable of structurally preventing an electric shock from occurring due to an operator's mistake or the like.

2. Description of the Related Art

A first connector which is one of a pair of connectors supplying power to an electric vehicle or the like may be installed in a device such as an inverter or a motor. A second connector which is the other connector may be mounted on the first connector to be attachable to or detachable from the first connector while a power supply cable or the like is connected thereto. In general, a male terminal among terminals of the first and second connectors which form the pair of connectors may be provided at one side and a female terminal may be provided at another side.

The male terminal among these terminals may be provided such that one end thereof is accommodated inside an open housing of a conductor including the male terminal but is likely to be touched by an operator's finger or the like according to the size of an opening of the housing, a depth in which the male terminal is provided, etc., thereby causing a safety accident such as an electric shock to occur.

In particular, the safety of the connector should be verified through a standard test generally performed to decrease the danger of such a safety accident, e.g., a safety test using a standard finger jig according to IEC60529 SPEC IP2XB.

In the safety test using the standard finger jig according to the IEC60529 SPEC IP2XB, whether a terminal of a high-voltage male connector is touched by a finger jig which is an artificial joint having the same shape as a human body's finger is tested. The shape of the finger jig which is a finger-shaped artificial joint has been disclosed but particular design conditions of the size of the terminal of the high-voltage male connector which faces an external opening, the size of a housing of the high-voltage male connector, etc. are not known.

As published related art, Japanese Unexamined Patent Application Publication No. 2011-048983 simply discloses that a covering 26 of a pin type terminal unit 22 corresponding to a terminal is thick enough not to be in contact with a finger jig for use in a test but does not provide a guideline about the size of an insertion space. Similarly, Japanese Unexamined Patent Application Publication No. 2002-056919 discloses that a control block unit 58 protrudes at a mouth of a narrow diameter portion 55 corresponding to an inner housing so that a tab 51 corresponding to a terminal may not be accessible by a finger jig for use in a test but does not suggest a particular design range of the size of the inner housing and the like.

SUMMARY

The technical purpose of the present invention is to provide a male connector among a pair of high-voltage connectors, which is capable of structurally preventing an electric shock from occurring due to an operator's mistake or the like.

In accordance with an aspect of the present invention, the above and other objects can be accomplished by the provision of a high-voltage male connector comprising a male terminal formed of a metal material and having a plate shape, an insulating cap provided on a front end of the male terminal, an inner housing into which the male terminal is inserted and mounted such that the front end of the male terminal faces the outside, a partition unit integrally formed with an inner side of the inner housing and having a tetragonal pipe shape covering the male terminal and an outer housing which is formed of a metal material and into which the inner housing is inserted and mounted, wherein, if a shortest distance between a top or bottom surface of the male terminal and an inner top or bottom surface of the partition unit is defined as an insertion height, a shortest distance between a left or right side surface of the male terminal and an inner side surface of the partition unit is defined as an insertion width, and a shortest distance between a front end of the partition unit and a conductive portion of the male terminal is defined as a conductive portion depth, the insertion height is greater than or equal to the insertion width and is in a range of 2.5 mm to 12.0 mm.

And when the insertion height is in a range of 2.5 mm to 3.1 mm, the conductive portion depth may be 0.3 times or more than the insertion height.

And when the insertion height is in a range of 3.1 mm to 4.0 mm, the conductive portion depth may be 0.63 times or more than the insertion height.

And when the insertion height is in a range of 4.0 mm to 12.0 mm, the conductive portion depth may be 1.1 times or more than the insertion height.

And a width or thickness of a front end portion of the insulating cap may be less than that of the male terminal.

And the insulating cap may comprise an inclined portion such that a width or thickness of the front end portion thereof is less than that of the male terminal.

And the insulating cap may be insert-injection molded.

And the high-voltage male connector may further comprise at least one protruding portion integrally formed with the front end of the male terminal and inserted into the insulating cap.

And the at least one protruding portion may have a plate shape which is thinner than the male terminal.

And the at least one protruding portion may comprise a width reduction portion having a width less than a maximum width thereof.

And the width reduction portion may be located between a portion of the at least one protruding portion having the maximum width and a front cross-section of the male terminal.

And the at least one protruding portion may comprise at least one through-hole which passes through the at least one protruding portion in a lengthwise direction thereof.

And the at least one protruding portion may comprise at least one separation-preventing bump protruding from a surface thereof.

BRIEF DESCRIPTION OF THE DRAWINGS

FIG. 3 is a perspective view of a finger jig for use in a standard safety test performed on a connector or the like;

DETAILED DESCRIPTION

Figure 1:
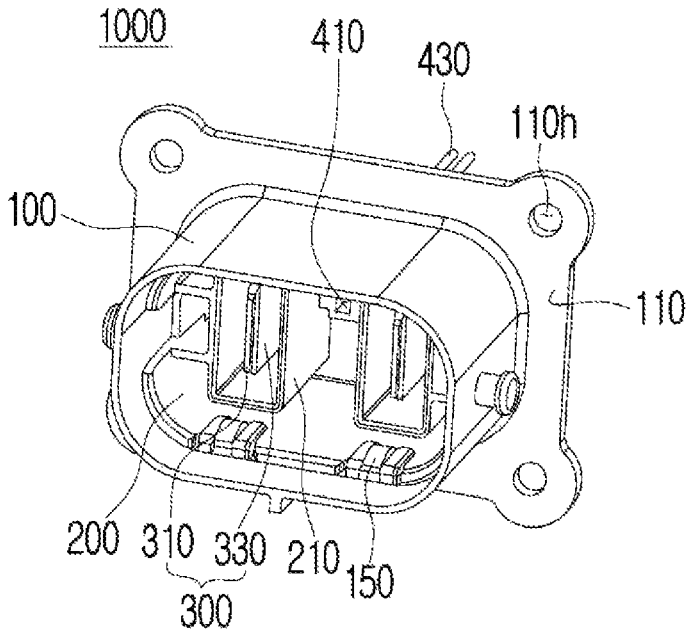
FIG. 1 illustrates a perspective view and a top view of a high-voltage male connector according to an embodiment of the present invention.
Figure 1:
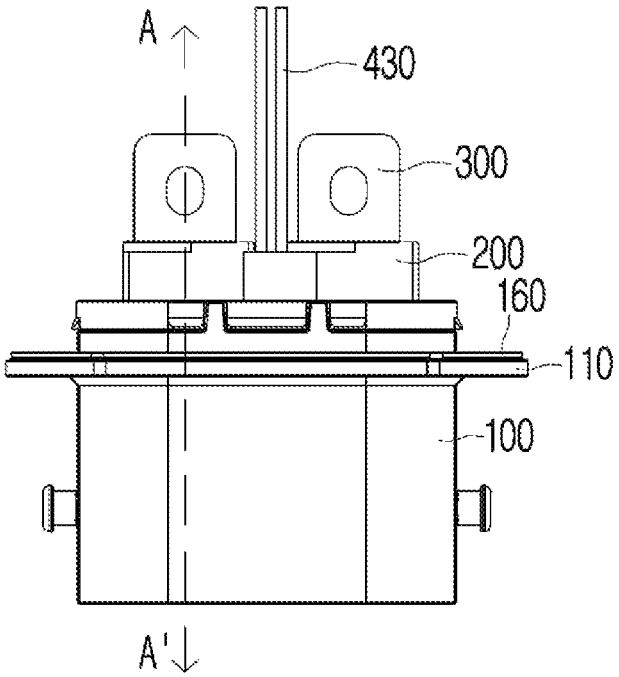

Hereinafter, exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. The same reference numerals represent the same elements throughout the drawings.

Figure 2:
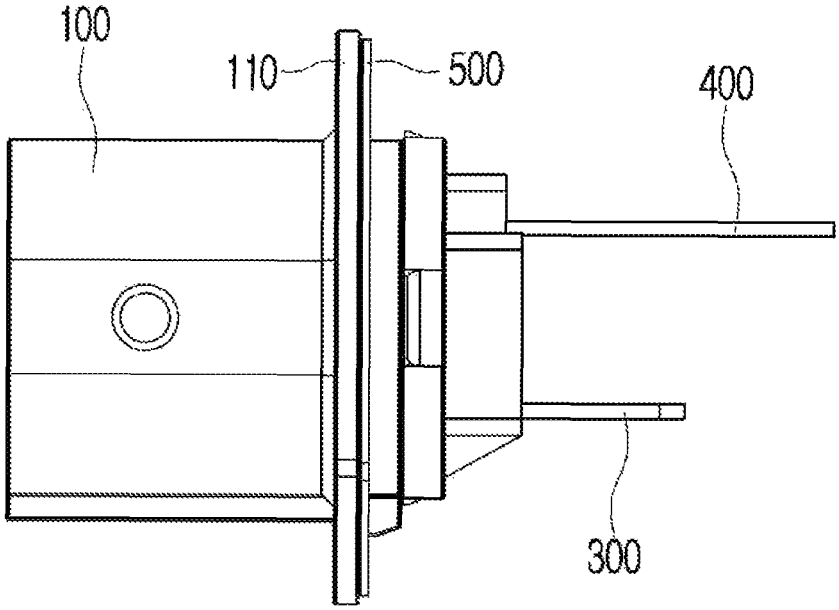
FIG. 2 illustrates a side view and a side cross-sectional view of the high-voltage male connector of FIG. 1.
Figure 2:
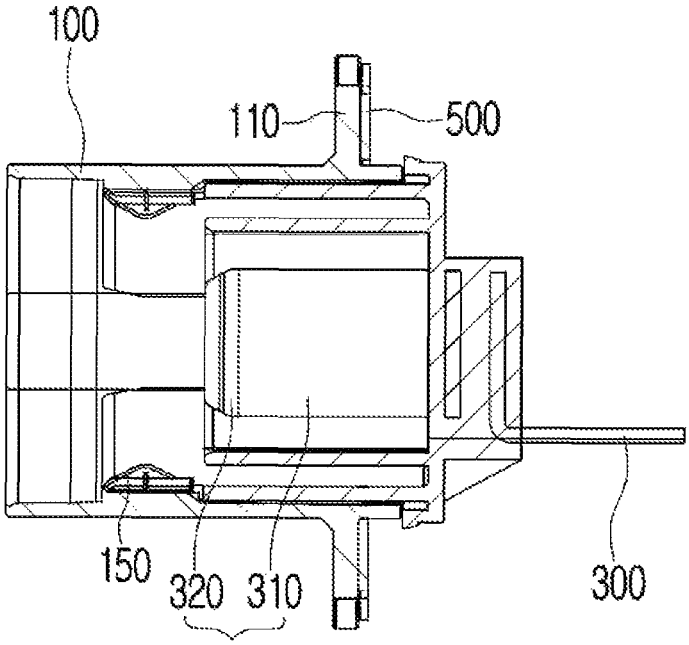

FIG. 1 illustrates a perspective view and a top view of a high-voltage male connector 1000 according to an embodiment of the present invention. FIG. 2 illustrates a side view and a side cross-sectional view of the high-voltage male connector 1000 of FIG. 1.

In detail, FIG. 1(*a*) is a perspective view of the high-voltage male connector 1000. FIG. 1(*b*) is a top view of the high-voltage male connector 1000. FIG. 2(*a*) is a side view of the high-voltage male connector 1000. FIG. 2(*b*) is a side cross-sectional view taken along line A-A' of FIG. 1(*b*).

In general, a high-voltage connector may include a pair of a first connector and a second connector. The first connector is mounted on a device. The second connector is coupled to the first connector via a cable to be attachable to or detachable from the first connector. Each of the first and second connectors may be classified as a male connector or a female connector according to the shape of a terminal thereof.

The male connector may include a male terminal. The female connector may include a female terminal into which the male connector of the male connector may be inserted.

The high-voltage male connector 1000 of FIG. 1 may be classified as the first connector or the male connector which is mounted on a device (not shown). A general high-voltage connector may have a structure in which an inner housing formed of an insulating material, e.g., resin, is provided in a metallic outer housing having a shielding/grounding function and a terminal is inserted into the inner housing.

The inner housing of the high-voltage male connector may be inserted into the outer housing and assembled with the outer housing or may be manufactured according to an insert-injection method. An example in which an inner housing 200 is inserted into an outer housing 100 is illustrated in the embodiments illustrated in FIGS. 1 and 2.

The high-voltage male connector 1000 of FIG. 1 according to an embodiment of the present invention may include two male terminals 300 each having a plate shape. Each of the male terminals 300 may have a plate shape which is bent such that front and rear sides thereof are perpendicular to each other.

Each of the male terminals 300 is a high-voltage power supply terminal. Thus, the high-voltage male connector 1000 may include an interlock terminal 400 (see FIG. 8) which is first disconnected when a pair of first and second connectors are disengaged from each other so as to prevent sparks or a safety accident from occurring during separation of the male terminals 300.

As illustrated in FIG. 1, the interlock terminal 400 is inserted into a rear side of the high-voltage male connector 1000 and mounted in an installation slot 410 while a signal transmission cable 430 is coupled thereto. The signal transmission cable 430 may be coupled to a power controller (not shown) to transmit a signal for supplying power to or blocking the supply of power to the male terminals 300 as the interlock terminal 400 is connected or disconnected.

That is, when the first and second connectors are disengaged from each other, the interlock terminal 400 is separated before the male terminals 300 are separated, so that the supply of power to the male terminals 300 may be blocked to prevent an electric arc, sparks, or the like from occurring when the first and second connectors are disengaged from each other.

The outer housing 100 may include a flange 110 through which the high-voltage male connector 1000 according to an embodiment of the present invention is mounted on a device (not shown). The flange 110 may include fastening holes 110*h* configured to fasten the high-voltage male connector 1000 with the device.

A sealing member 160 may be provided on a surface of the flange 110 of the high-voltage male connector 1000 according to an embodiment of the present invention, which is to be in contact with the device. The sealing member 160 may seal a gap between the high-voltage male connector 1000 according to an embodiment of the present invention and the device when the high-voltage male connector 1000 is mounted on the device.

In the high-voltage male connector 1000 according to an embodiment of the present invention, the outer housing 100 may include a plurality of elastic contact pieces 150.

The plurality of elastic contact pieces 150 are provided to make the outer housing 100 of the high-voltage male connector 1000 be stably in contact with an outer housing of a female connector (not shown) engaged with the outer housing 100 of the high-voltage male connector 1000. The plurality of elastic contact pieces 150 may make these outer housings (which are formed of a metal material) of the high-voltage male connector 1000 and the female connector be in contact with each other at a plurality of points while these connectors are engaged with each other, and may elastically support these connectors in contact with each other at the plurality of points, thereby improving the shielding performance thereof.

The inner housing 200 of the high-voltage male connector 1000 according to an embodiment of the present invention may include a partition unit 210 having a tetragonal pipe shape to protect the male terminal 300, so that the male terminals 300 may be prevented from being broken, the terminals of the female connector and the high-voltage male connector 1000 may be guided during installation of these connectors, and a safety accident such as electric shock may be prevented from occurring due to an operator's mistake in a state in which these connectors are disengaged from each other.

The partition unit 210 may be integrally formed with the inner housing 200.

As illustrated in FIG. 1, the partition unit 210 may be configured to cover the male terminal 300, and have an open front side such that the high-voltage male connector 1000 may be inserted into a female terminal of a high-voltage female connector (not shown) when these connectors are engaged with each other.

Although the partition unit 210 is provided, an operator may get shocked when the male terminal 300 is touched by the operator's finger or the like due to the operator's carelessness. Thus, an insulating cap 310 is provided on an exposed end portion of the male terminal 300 of the high-voltage male connector 1000.

When the insulating cap 310 is provided, a possibility that an operator will mistakenly touch the male terminal 300 with his or her finger may be greatly decreased owing to the insulating cap 310 and the partition unit 210.

Although the partition unit 210 is formed in the inner housing 200 of the high-voltage male connector 1000 and the insulating cap 310 is provided on the end portion of the male terminal 300, when a space between the partition unit 210 and the male terminal 300 (i.e., a space into which an operator's finger may be inserted) is large, the operator's finger or the like may be likely to be inserted into the space and thus may be in touch with a metallic conductive portion 330 of the male terminal 300 behind the insulating cap 310, thereby causing an electric shock to occur.

In general, in order to decrease the risk of a safety accident, a standard safety test is required to be performed on a high-voltage connector. The high-voltage connector should pass the standard safety test.

Figure 3:
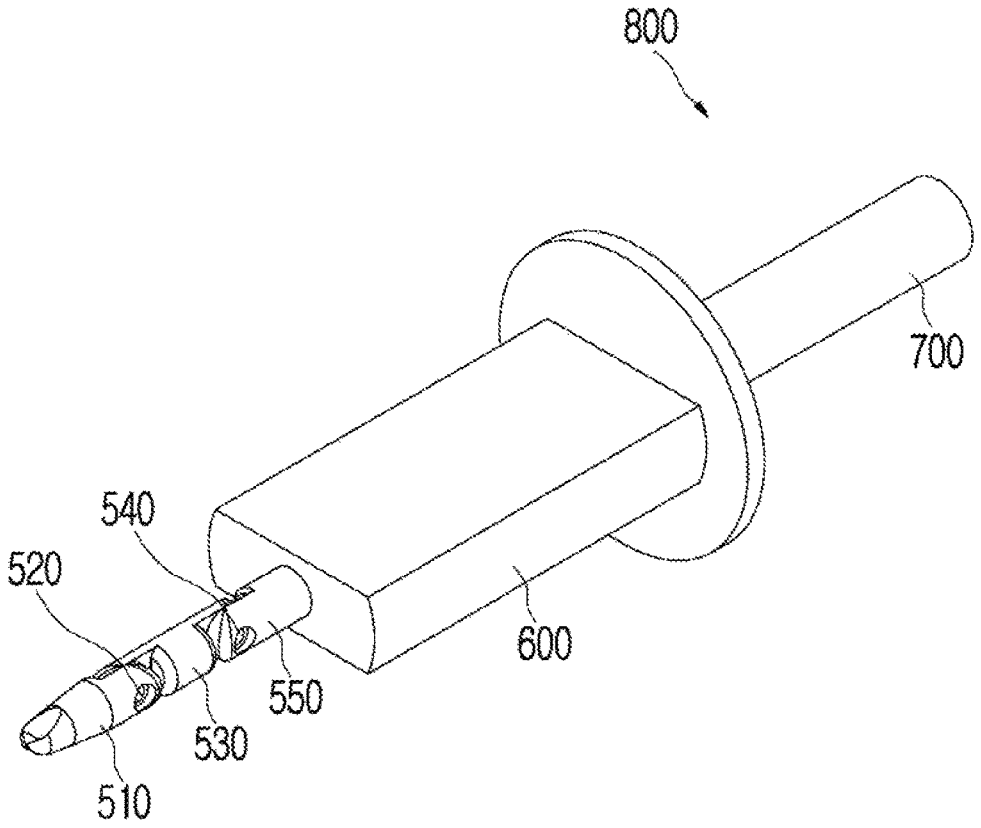

FIG. 3 is a perspective view of a finger jig 500 for use in a standard safety test performed on a connector or the like.

The standard safety test related to high-voltage connectors may be a safety test according to the IEC60529 SPEC or the like. The finger jig 500 for use in the standard safety test has a shape corresponding to a finger of hands of a human body.

Thus, the finger jig 500 may include two joints 520 and 540 which are rotatable in the same direction and three phalanges 510, 520, and 530, similar to a human body's finger. The finger jig 500 may be mounted on a palm unit 600 corresponding to a human body's palm. The palm unit 600 may be coupled to a forearm unit 700 which forms a safety test device 800 and through which force is applied.

As described above, the finger jig 500 is formed of a conductive metallic material and has a variable shape corresponding to an operator's finger. Thus, the finger jig 500 is used in a standard safety test.

Figure 4:
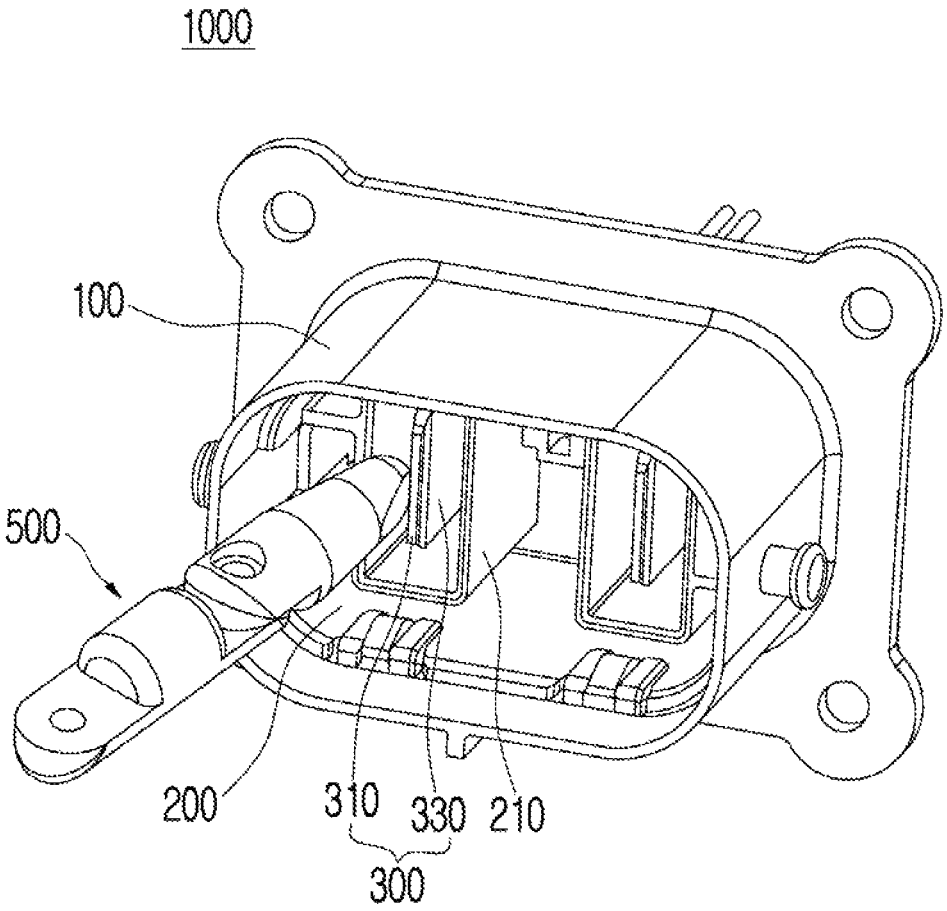
FIG. 4 is a diagram illustrating a standard safety test performed on a high-voltage male connector according to an embodiment of the present invention using the finger jig of FIG. 3.

FIG. 4 is a diagram illustrating a standard safety test performed on a high-voltage male connector 1000 according to an embodiment of the present invention using the finger jig 500 of FIG. 3.

The standard safety test performed on the high-voltage male connector 1000 will be described in detail below. It is determined whether the high-voltage male connector 1000 passes the standard safety test by inserting the finger jig 500 between a male terminal 300 having a plate shape and a partition unit 210 having a tetragonal pipe shape covering the male terminal 300 by applying a force of 10N±10% to the finger jig 500 and then checking whether a distal phalange 510 of the finger jig 500 or the like is in contact with a conductive portion 330 of the male terminal 300.

In detail, whether the finger jig 500 and the male terminal 300 are in contact with each other is determined by applying a load of a rated voltage exceeding 1,000 V AC or 1,500V DC to the male terminal 300 of the high-voltage male connector 1000 and providing a lamp on a circuit formed when the finger jig 500 and the male terminal 300 are connected to each other so that the lamp may be turned on when the finger jig 500 and the male terminal 300 are in contact with each other.

Thus, if the lamp is not turned on when the force of 10N±10% is applied to the finger jig 500 to insert the finger jig 500 in various directions between the male terminal 300 and the partition unit 210 having the tetragonal pipe shape covering the male terminal 300, it may be determined that the high-voltage male connector 1000 passes the standard safety test.

The inner housing 200 and the partition unit 210 which are elements of the high-voltage male connector 1000 may be integrally formed with each other. The inner housing 200 may be formed of synthetic resin. Thus, even if a width between the male terminal 300 having the plate shape and the partition unit 210 having the tetragonal pipe shape covering the male terminal 300 is designed to be less than a width of an end portion of the finger jig 500, the partition unit 210 of the inner housing 200 may be elastically deformed when a predetermined force or more is applied thereto and thus the male terminal 300 and the finger jig 500 may be in contact with each other. Accordingly, the safety of the high-voltage male connector 1000 is not guaranteed.

Thus, in order to design high-voltage male connector to pass the standard safety test, size conditions, such as a distance between the male terminal 300 and the partition unit 210 covering the male terminal 300 and an installation depth of the male terminal 300, should be controlled.

Figure 5:
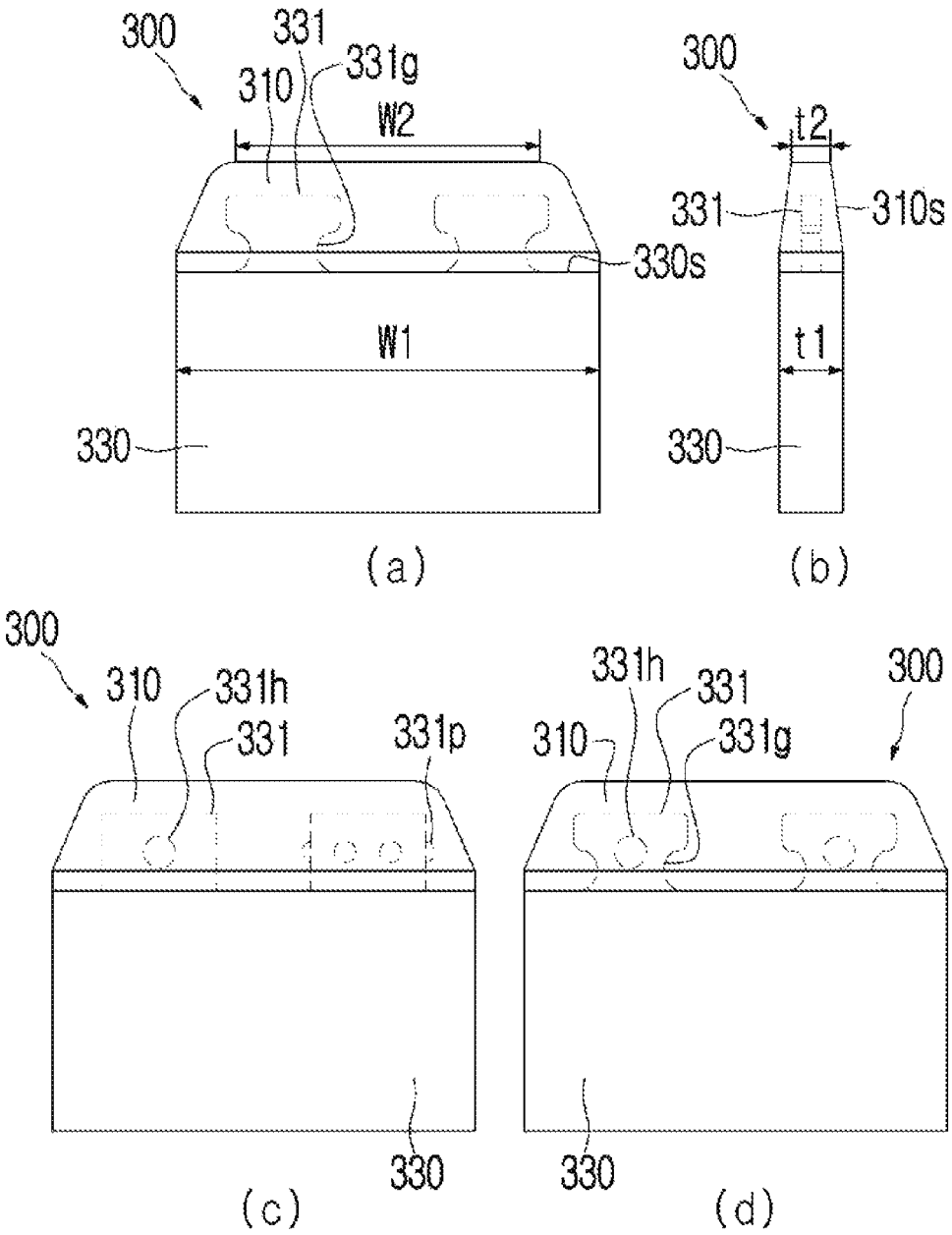
FIG. 5 illustrates a male terminal of a high-voltage male connector according to an embodiment of the present invention.

FIG. 5 illustrates a male terminal 300 of a high-voltage male connector 1000 according to an embodiment of the present invention. In detail, FIG. 5(*a*) is an expanded plan view of an outer end portion of the male terminal 300. FIG. 5(*b*) is a side view of the outer end portion of the male terminal 300 of FIG. 5(*a*). FIGS. 5(*c*) and (*d*) illustrate male terminals 300 according to other embodiments of the present invention.

The high-voltage male connector 1000 according to an embodiment of the present invention includes the male terminal 300 having a plate shape and a partition unit 210 having a tetragonal pipe shape covering the male terminal 300. The partition unit 210 may prevent an operator from getting shocked due to his or her carelessness. However, when the operator's finger approaches the inside of an opening of the partition unit 210, the operator's finger may be in contact with a front end of the male terminal 300 and thus the operator may get shocked. Thus, an insulating cap 310 may be provided on an end portion of the male terminal 300 having the plate shape to effectively prevent the operator from getting shocked due to his or her carelessness.

The insulating cap 310 may be formed of a resin material which is an insulating material or the like. An insert-injection method may be used to add the insulating cap 310 on the end portion of the male terminal 300 having a thin plate shape of the high-voltage male connector 1000 according to an embodiment of the present invention.

The insulating cap 310 may be provided according to a method other than the insert-injection method. For example, the insulating cap 310 may be attached onto the high-voltage male connector 1000, may be forced to be put into the high-voltage male connector 1000, or may be inserted into and engaged with the high-voltage male connector 1000. However, since the male terminal 300 has a thin thickness, it may be difficult to secure a sufficient contact area or to form an engagement structure or an insertion structure (a hole, a bump, or the like).

Thus, at least one protruding portion 331 may be provided at one end portion of the male terminal 300 to be insert-injected into an inner side of the insulating cap 310.

The number of the at least one protruding portion 331 may be one or a plurality of protruding portions 331 may be provided according to the width, thickness, or the like of the male terminal 300. Examples in which two protruding portions 331 are provided at one end portion of the male terminal 300 are described in the embodiments illustrated in FIG. 5.

As illustrated in FIG. 5(*b*), the at least one protruding portion 331 may have a plate shape which is thinner than a conductive portion 330 of the male terminal 300 and may be integrally formed with the male terminal 300. The insulating cap 310 and the conductive portion 330 may be the same in thickness.

Furthermore, as illustrated in FIG. 5, the at least one protruding portion 331 may include a width reduction portion 331*g* to decrease a width thereof, so that the at least one protruding portion 331 may not be easily separated from the insulating cap 310 after being insert-injected into the insulating cap 310.

A width of the at least one protruding portion 331 decreases at the width reduction portion 331*g* thereof. Thus the insulating cap 310 may be prevented from being easily separated from the at least one protruding portion 331 in a state in which the at least one protruding portion 331 is inserted into the insulating cap 310.

Furthermore, as illustrated in FIG. 5, the width reduction portion 331*g* may be located between a maximum-width portion of the at least one protruding portion 331 and a front cross-section 330*s* of the male terminal 300.

In order to prevent the insulating cap 310 and the male terminal 300 from being easily separated from each other after the at least one protruding portion 331 is inserted into the insulating cap 310, a method of forming a through-hole 331*h* in the at least one protruding portion 331 in a widthwise direction of the at least one protruding portion 331 or a method of forming a separation-preventing bump 331*p* at a surface of the at least one protruding portion 331 may be used as illustrated in FIG. 5(*c*), as well as the method of forming the width reduction portion 331*g* by decreasing the width of the at least one protruding portion 331.

The method of forming the through-hole 331*h* and the method of forming the separation-preventing bump 331*p* may be performed together or independently.

An injection-molding material may be applied to the insulating cap 310 via the through-hole 331*h* in a widthwise direction of the insulating cap 310, and thus the insulating cap 310 may be prevented from being easily separated from the male terminal 300.

According to the method of forming the separation-preventing bump 331*p*, the separation-preventing bump 331*p* may serve as a stopper at a surface of an inner side of the insulating cap 310 after the insulating cap 310 is insert-injected, thereby preventing the insulating cap 310 from being easily separated.

Although not shown, the insulating cap 310 may be prevented from being separated by forming a dent to a certain depth in the widthwise direction of the at least one protruding portion 331, similar to the method of forming the separation-preventing bump 331*p*.

Furthermore, a method of decreasing the width of the at least one protruding portion 331 of FIG. 5(*a*) and the method of forming the through-hole 331*h* in the at least one protruding portion 331 of FIG. 5(*c*) may be simultaneously performed as illustrated in FIG. 5(*d*).

As shown in the embodiment of FIG. 5(*d*), the insulating cap 310 may be more firmly fixed by forming the through-hole 331*h* in the at least one protruding portion 331, as well as forming the width reduction portion 331*g* by reducing the width of the at least one protruding portion 331. In addition, the separation-preventing bump 331*p* or the dent may be also formed.

A width w2 or a thickness t2 of a front end portion of the insulating cap 310 may be set to be less than a width w1 or a thickness t1 of the conductive portion 330 of the male terminal 300.

In detail, the insulating cap 310 may include an inclined portion 310*s* such that a width or thickness of the front end portion of the insulating cap 310 is less than that of the male terminal 300.

Due to the above structure, resistance and physical friction that may occur when the male terminal 300 is inserted into a female terminal may be minimized during engagement of a pair of the high-voltage male connector 1000 and a high-voltage female connector.

In the high-voltage male connector 1000 including the insulating cap 310 of FIG. 5 according to an embodiment of the present invention, the insulating cap 310 and the male terminal 300 may be prevented from being separated from each other by providing the at least one protruding portion 331 on the end portion of the male terminal 300, thereby improving the performance of preventing an electric shock from occurring.

Figure 6:
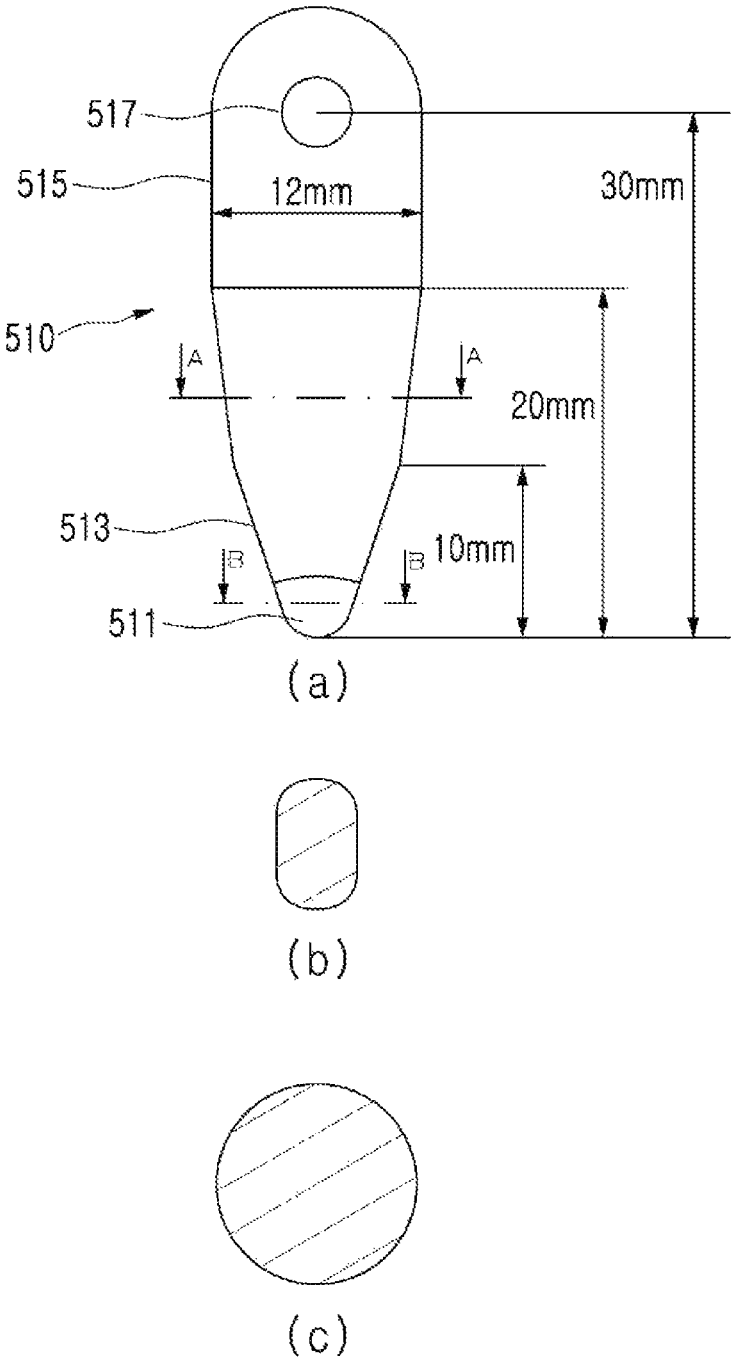
FIG. 6 illustrates a plan view and cross-sectional views of a distal phalange of a finger jig for use in a standard safety test.

FIG. 6 illustrates a plan view and cross-sectional views of a distal phalange 510 of a finger jig 500 for use in a standard safety test.

The distal phalange 510 of the finger jig 500 is about 30 mm in length. The distal phalange 510 of the finger jig 500 has a round shape having a diameter of about 12 mm in the vicinity of a joint portion thereof, i.e., a hinge hole 517 but tapers toward an end portion 511 thereof, similar to a human body's finger. The distal phalange 510 has a flat shape as illustrated in FIG. 6(*b*) which is a cross-sectional view taken along line B-B of FIG. 6(*a*).

Furthermore, the diameter of the distal phalange 510 may be uniform in the vicinity of the hinge hole 517 as illustrated in FIG. 6(*c*) which is a cross-sectional view of taken along line A-A of FIG. 6(*a*) but may decrease starting from a position spaced about 20 mm apart from the end portion 511 in a direction of the hinge hole 517.

A radius of curvature of the end portion 511 of the distal phalange 510 of the finger jig 500 is about 2 mm in a direction in which the joints of the finger jig 500 rotate, and is about 4 mm in a direction perpendicular to the above direction.

Thus, if the standard safety test is performed on the high-voltage male conductor 1000 using the finger jig 500 of FIG. 6, it may be determined that the high-voltage male conductor 1000 fails to pass the standard safety test when the finger jig 500 may be inserted into a gap between the male terminal 300 and the partition unit 210 in a direction in which the end portion 511 of the distal phalange 510 of the finger jig 500 has a flat shape and may thus be in contact with the conductive portion 30 of the male terminal 300.

Figure 7:
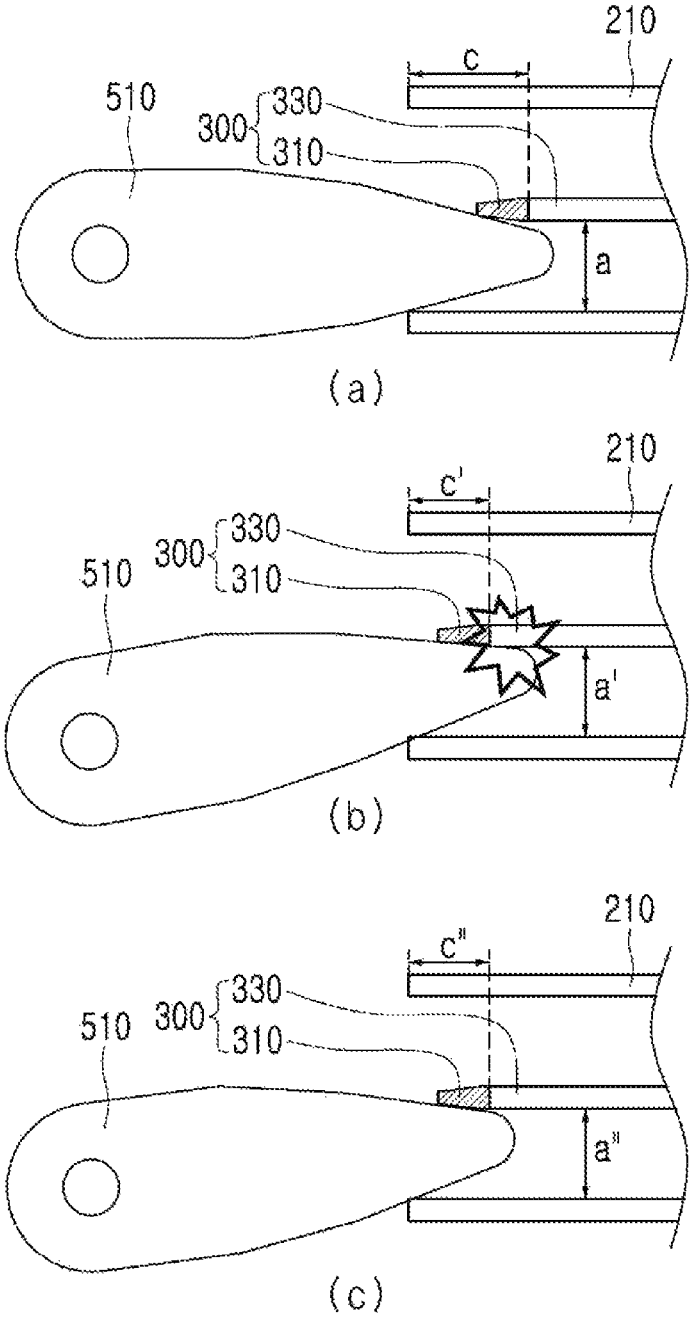
FIG. 7 illustrates examples of a result of a safety test using the finger jig of FIG. 3.

FIG. 7 illustrates examples of a result of a standard safety test using the finger jig 500 of FIG. 3.

In detail, FIG. 7(*a*) illustrates a case in which the result of the standard safety test was positive. FIG. 7(*b*) illustrates a case in which the result of the standard safety test was negative. FIG. 7(*c*) illustrates a case in which it was difficult to determine whether the result of the standard safety test is positive or negative. The finger jig 500 used in the standard safety test performed on a high-voltage male connector 1000 illustrated in each of FIG. 7(*a*) to (*c*) has the same size.

In the high-voltage male connector 1000 of FIG. 7(*a*), a male terminal 300 includes an insulating cap 310 at a front end thereof. Thus, although the front end of the male terminal 300 having the insulating cap 310 was in contact with a distal phalange 510 of the finger jig 500, an electric shock did not occur.

Furthermore, a shortest distance between a front end of a partition unit 210 and a conductive portion 330 of the male terminal 300 (hereinafter referred to as 'conductive portion depth c') was sufficiently secured. In addition, a shortest distance between a top or bottom surface of the conductive portion 330 of the male terminal 300 and an inner top or bottom surface of the partition unit 210 (hereinafter referred to as 'insertion height a') was small. Thus, although the distal phalange 510 of the finger jig 500 was inserted at a different angle, the distal phalange 510 of the finger jig 500 and the conductive portion 330 of the male terminal 300 did not contact each other.

A certain force is applied to the finger jig 500 when a safety test according to the IEC60529 SPEC is performed. However, since an insertion space is small and the conductive portion 330 is appropriately provided at an inner side of the partition unit 210, it may be determined that the high-voltage male connector 1000 of FIG. 7(*a*) passed the safety test according to the IEC60529 SPEC.

In contrast, in the case of the high-voltage male connector 1000 of FIG. 7(*b*), a conductive portion depth c' is lower than the conductive portion depth c of FIG. 7(*a*) and an insertion height a' is greater than the insertion height a of FIG. 7(*a*). Thus, when an angle of a distal phalange 510 of the finger jig 500 is appropriately changed, the distal phalange 510 of the finger jig 500 and the conductive portion 330 of the male terminal 300 may be in contact with each other. When the high-voltage male connector 1000 is actually used, a safety accident, e.g., an electric shock, may occur due to an operator's carelessness. Accordingly, it may be determined that the high-voltage male connector 1000 of FIG. 7(*b*) did not pass the safety test according to the IEC60529 SPEC.

In the case of the high-voltage male connector 1000 of FIG. 7(*c*), whether a result of the safety test performed thereon is positive or not may be determined according to a conductive portion c", an insertion height a", etc.

As described above, the finger jig 500 used in the safety test according to the IEC60529 SPEC has a standard size. Thus, a numerical range of the high-voltage male connector 1000 including the male terminal 300, the partition unit 210, etc. may be defined through a prior experiment, a computer simulation, or the like by adjusting the conductive portion depth c, the insertion height a, and an insertion width which is to be defined below, so that the high-voltage male connector 1000 may pass a safety test.

When conditions of the numerical range of the high-voltage male connector 1000 which may pass the safety test are secured, these conditions may serve as a guideline for a conductive portion depth c, an insertion height a, an insertion width, etc. of a new connector during designing of the new conductor. Accordingly, it is possible to reduce unnecessary waste of time or costs during development of a product.

Figure 8:
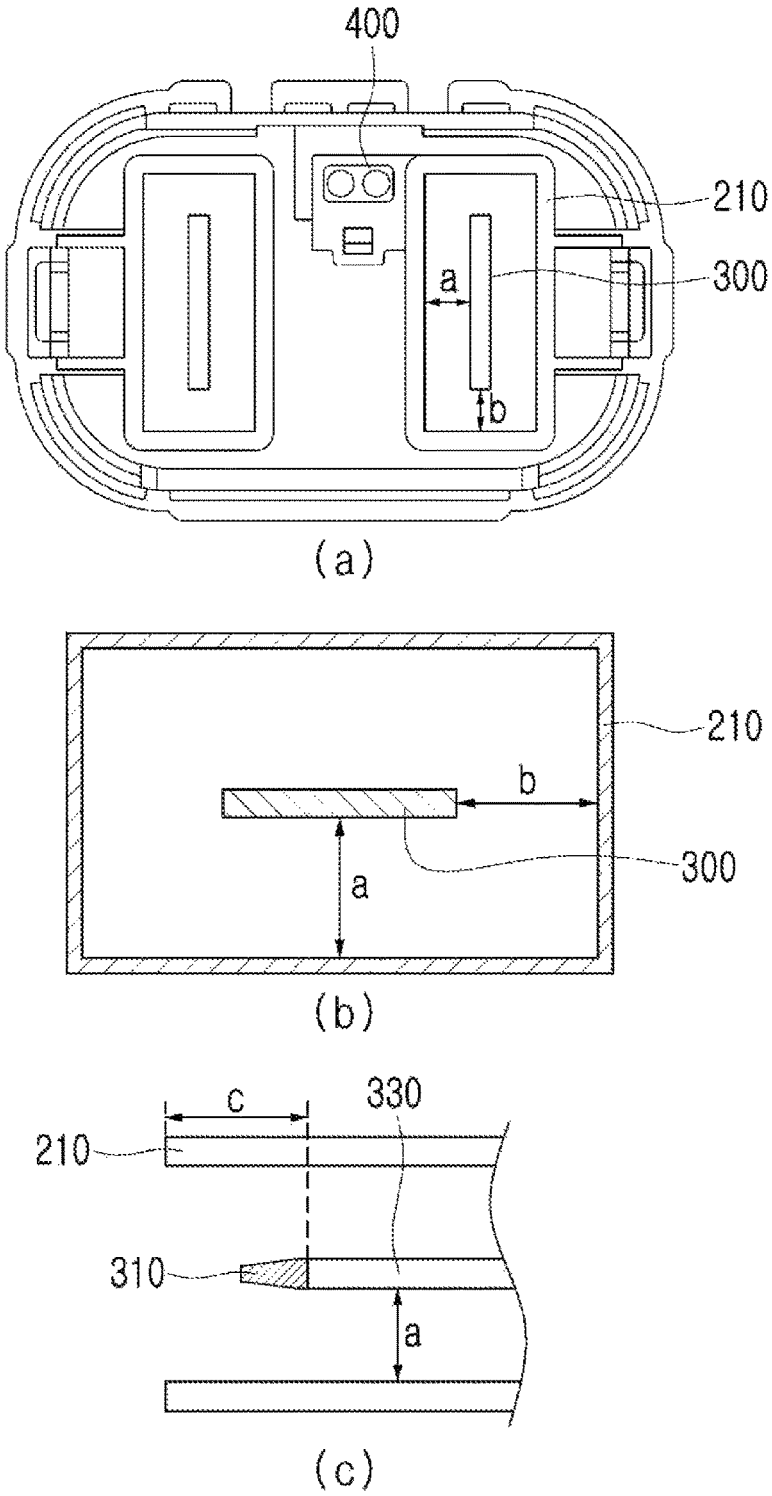
FIG. 8 illustrates an inner housing with male terminals of a high-voltage male connector according to an embodiment of the present invention.

FIG. 8 illustrates an inner housing 200 with male terminals 300 of a high-voltage male connector (not shown) according to an embodiment of the present invention. In detail, FIG. 8(*a*) is a front view of the inner housing 200 with the male terminals 300 of the high-voltage male connector according to an embodiment of the present invention. FIG. 8(*b*) is an expanded front view of one of the male terminals 300 of the inner housing 200 and a partition unit 210 covering the male terminal 300. FIG. 8(*c*) is a side cross-sectional view of the male terminal 300 and the partition unit 210 of FIG. 8(*b*).

As described above, a possibility that a conductive portion 330 of the male terminal 300 will be touched by the finger jig 500 having the standard size should be zero or extremely low according to size conditions of the conductive portion depth c, the insertion height a, and the insertion width b of the high-voltage male connector including the male terminal 300, the partition unit 210, etc., so that the high-voltage male connector may pass a safety test according to the IEC60529 SPEC or the like.

The conductive portion depth c and the insertion height a have been already described above, and a shortest distance between a side surface of the male terminal 300 having a plate shape and an inner side surface of the partition unit 210 having a tetragonal pipe shape will be defined as an "insertion width b".

Thus, a possibility that the conductive portion 330 of the male terminal 300 and the finger jig 500 for use in the safety test will be in contact with each other may be determined by the conductive portion depth c, the insertion height a, and the insertion width b of the high-voltage male connector.

As the conductive portion depth c increases, the possibility that the male terminal 300 and the finger jig 500 will be in contact with each other decreases. In contrast, as the insertion height a and the insertion width b increase, the possibility that the male terminal 300 and the finger jig 500 will be in contact with each other increases.

Thus, the conductive portion depth c, the insertion height a, and the insertion width b of the high-voltage male connector which includes the male terminal 300 having the plate shape and the partition unit 210 having the tetragonal pipe shape and which may pass the safety test according to the IEC60529 SPEC may be determined through an experiment and a computer simulation using the finger jig 500 having the standard size, as will be described below.

Basically, the finger jig 500 has a maximum diameter of 12 mm and a possibility of a case in which insertion width b is greater than the insertion height a, (i.e., $a<b$), is low when the high-voltage male connector is actually designed. Thus, the case in which $a<b$ is excluded from conditions of the insertion height a and the insertion width b of the high-voltage male connector which may pass the safety test. Similarly, a case in which the finger jig 500 is not likely to be inserted into the high-voltage male connector regardless of a shape of the distal phalange 510 of the finger jig 500 and thus the risk of electric shock is low, i.e., a case in which the insertion height a is less than 2.5 mm, or a case in which the insertion height a is determined to be greater than the maximum diameter of the finger jig 500 and thus the risk of electric shock is very high, i.e., a case in which the insertion height a exceeds 12 mm, is excluded from the conditions of the insertion height a and the insertion width b of the high-voltage male connector which may pass the safety test.

Furthermore, when it is considered that the end portion 511 of the distal phalange 510 has a radius of curvature of 2 to 4 mm, conditions that the high-voltage male connector may pass the safety test according to the IEC60529 SPEC or the like may be subdivided according to a range of the insertion height a, as will be described below.

In the high-voltage male connector according to an embodiment of the present invention, the insertion width b should be equal to or less than the insertion height a in relations among the conductive portion depth c, the insertion height a, and the insertion width b between the male terminal 300 and the partition unit 210, as described above.

If 2.5 mm≤insertion height a<3.1 mm, a relation of 0.3×insertion height a≤conductive portion depth c is formed. If 3.1 mm≤insertion height a<4.0 mm, a relation of 0.63× insertion height a≤conductive portion depth c is formed. If 4.0 mm≤insertion height a<12.0 mm, a size of the partition unit 210 of the inner housing 200, positions of an insulating cap 310 and the male terminal 300, etc. should be determined such that a relation of 1.1×insertion height a≤conductive portion depth c is satisfied.

As apparent from the above conditions, the insertion height a may have boundary values of 2.5 mm, 3.1 mm, 4.0 mm, and 12.0 mm. The conductive portion depth c should be 0.3 times or greater than the insertion height a, be 0.63 times or greater than the insertion height a, or be 1.1 times or greater than the insertion height a, so that the finger jig 500 and the conductive portion 330 of the male terminal 300 may be prevented from being in contact with each other in three sections each having the insertion height a ranging between 2.5 mm and 12.0 mm.

That is, as the insertion height a (or the insertion width b) increases, a space into which the finger jig 500 may be inserted increases. Thus, in order to prevent the male terminal 300 and the finger jig 500 from being in contact with each other, the male terminal 300 should be disposed deeply inside the partition unit 210.

When the above size conditions of the conductive portion depth c, the insertion height a, and the insertion width b are satisfied, the high-voltage male connector including the male terminal 300 having the plate shape and the partition unit 210 having the tetragonal pipe shape covering the male terminal 300 may pass the safety test according to the IEC60529 SPEC, since a possibility that the finger jig 500 and the conductive portion 330 of the male terminal 300 will be in contact with each other is low enough.

Thus, in a high-voltage male connector according to an embodiment of the present invention, a partition spaced a predetermined distance from a male terminal is integrally formed with an inner housing and an insulating cap is provided on an end portion of the male terminal so as to primarily prevent an operator from getting shocked. Furthermore, the operator may be structurally prevented from getting shocked by determining an insertion height, an insertion width, and a conductive portion depth to satisfy the above conditions.

Furthermore, in a high-voltage male connector according to an embodiment of the present invention, at least one protruding portion, a through-hole, a width reduction portion, a bump, or the like may be formed on an end portion of a male terminal and then be inserted into an insulating cap which is insert-injected so as to prevent the insulating cap and the male terminal from being separated from each other, thereby improving the performance of preventing an electric shock from occurring.

In addition, according to a high-voltage male connector according to an embodiment of the present invention, a guideline about a conductive portion depth, an insertion height, an insertion width, etc. of a conductor may be provided for design of a high-voltage male connector which may pass a standard safety test. Accordingly, it is possible to reduce unnecessary waste of time or costs during developing of a product.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. Accordingly, if modified examples of an embodiment of the present invention include the elements defined in the claims of the present invention, they should be construed as falling within the technical scope of the present invention.

What is claimed is:

1. A high-voltage male connector comprising:

a male terminal formed of a metal material and having a plate shape;

an insulating cap provided on a front end of the male terminal;

an inner housing into which the male terminal is inserted and mounted such that the front end of the male terminal faces the outside;

a partition unit integrally formed with an inner side of the inner housing and having a tetragonal pipe shape covering the male terminal; and an outer housing which is formed of a metal material and into which the inner housing is inserted and mounted, wherein a shortest distance between a top or bottom surface of the male terminal and an inner top or bottom surface of the partition unit is defined as an insertion height, a shortest distance between a left or right side surface of the male terminal and an inner side surface of the partition unit is defined as an insertion width, and a shortest distance between a front end of the partition unit and a conductive portion of the male terminal is defined as a conductive portion depth, the insertion height is greater than or equal to the insertion width and is in a range of 2.5 mm to 12.0 mm.

2. The high-voltage male connector of claim 1, wherein, when the insertion height is in a range of 2.5 mm to 3.1 mm, the conductive portion depth is 0.3 times or more than the insertion height.

3. The high-voltage male connector of claim 1, wherein, when the insertion height is in a range of 3.1 mm to 4.0 mm, the conductive portion depth is 0.63 times or more than the insertion height.

4. The high-voltage male connector of claim 1, wherein, when the insertion height is in a range of 4.0 mm to 12.0 mm, the conductive portion depth is 1.1 times or more than the insertion height.

5. The high-voltage male connector of claim 1, wherein a width or thickness of a front end portion of the insulating cap is less than that of the male terminal.

6. The high-voltage male connector of claim 5, wherein the insulating cap comprises an inclined portion such that a width or thickness of the front end portion thereof is less than that of the male terminal.

7. The high-voltage male connector of claim 1, wherein the insulating cap is insert-injection molded.

8. The high-voltage male connector of claim 7, further comprising at least one protruding portion integrally formed with the front end of the male terminal and inserted into the insulating cap.

9. The high-voltage male connector of claim 8, wherein the at least one protruding portion has a plate shape which is thinner than the male terminal.

10. The high-voltage male connector of claim 9, wherein the at least one protruding portion comprises a width reduction portion having a width less than a maximum width thereof.

11. The high-voltage male connector of claim 10, wherein the width reduction portion is located between a portion of the at least one protruding portion having the maximum width and a front cross-section of the male terminal.

12. The high-voltage male connector of claim 8, wherein the at least one protruding portion comprises at least one through-hole which passes through the at least one protruding portion in a lengthwise direction thereof.

13. The high-voltage male connector of claim 8, wherein the at least one protruding portion comprises at least one separation-preventing bump protruding from a surface thereof.

* * * * *